United States Patent [19]

Gilbert

[11] Patent Number: 4,479,548

[45] Date of Patent: Oct. 30, 1984

[54] SETTING TOOL ADAPTER KIT

[75] Inventor: Bruce Gilbert, Huntsville, Tex.

[73] Assignee: Hughes Tool Company, Houston, Tex.

[21] Appl. No.: 476,442

[22] Filed: Mar. 17, 1983

[51] Int. Cl.[3] ..... E21B 23/06

[52] U.S. Cl. ..... 166/387; 166/123; 285/39

[58] Field of Search ..... 166/387, 382, 381, 123–125, 166/134, 181, 120, 182, 299, 63; 285/3, 4, 30, 307, DIG. 21

[56] References Cited

U.S. PATENT DOCUMENTS

| | | | |
|---|---|---|---|
| 3,631,925 | 1/1972 | Nutter | 166/123 X |
| 3,749,166 | 7/1973 | Young | 166/123 |
| 3,991,826 | 11/1976 | Baugh | 166/120 |
| 4,151,876 | 5/1979 | Briggs et al. | 166/134 |
| 4,281,711 | 8/1981 | Braddick et al. | 166/118 |
| 4,363,358 | 12/1982 | Ellis | 166/212 |

*Primary Examiner*—James A. Leppink
*Assistant Examiner*—Thuy M. Bui
*Attorney, Agent, or Firm*—Robert A. Felsman; Charles D. Gunter, Jr.

[57] ABSTRACT

An adapter kit is shown for attaching a setting tool of the type having a power actuated outer sleeve and a cooperating inner tubular member to a well packer. The adapter kit includes a tubular mandrel having an upper end which is adapted to be connected to the setting tool inner tubular member and has a ramp area formed in a portion of the mandrel exterior. A collet having a collet body and a plurality of expansive collet fingers is slidably received about the tubular mandrel with the ramp area beneath the collet fingers to expand the fingers outwardly with respect to the mandrel. The collet fingers are provided with an outer threaded surface which is adapted to engage a mating internally threaded surface of the well packer when the collet fingers are expanded to the proper thread diameter by passing the mandrel ramp beneath the collet fingers. The collet is releasably secured in position by a shear wire with the fingers in the outwardly expanded position for engaging the packer internally threaded surface. A setting sleeve is engagable with the setting tool power actuated outer sleeve and engages the packer whereby actuation of the setting tool serves to move the setting tool and tubular mandrel in opposite relative directions to sever the shear wire and move the ramp area from beneath the collet fingers to disengage the collet and setting tool from the packer. The setting tool and setting sleeve can then be retrieved by a wireline from the wellbore leaving the packer in position.

5 Claims, 7 Drawing Figures

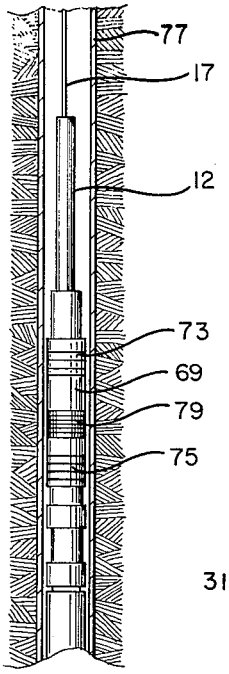
FIG. 1
FIG. 2a
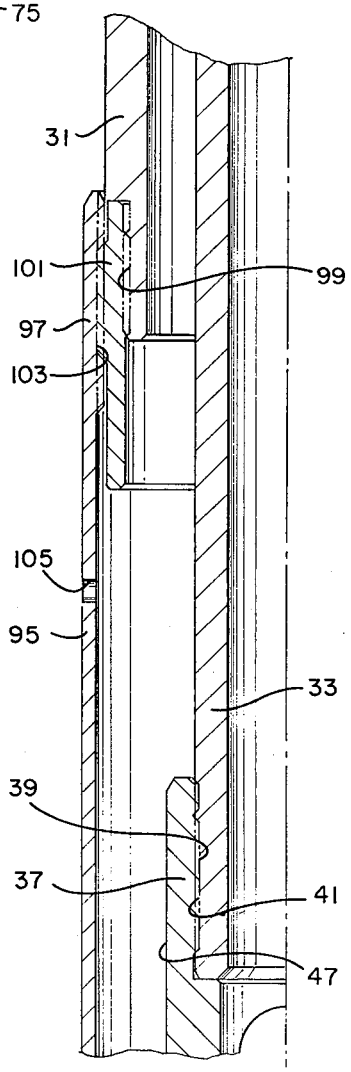
FIG. 2b
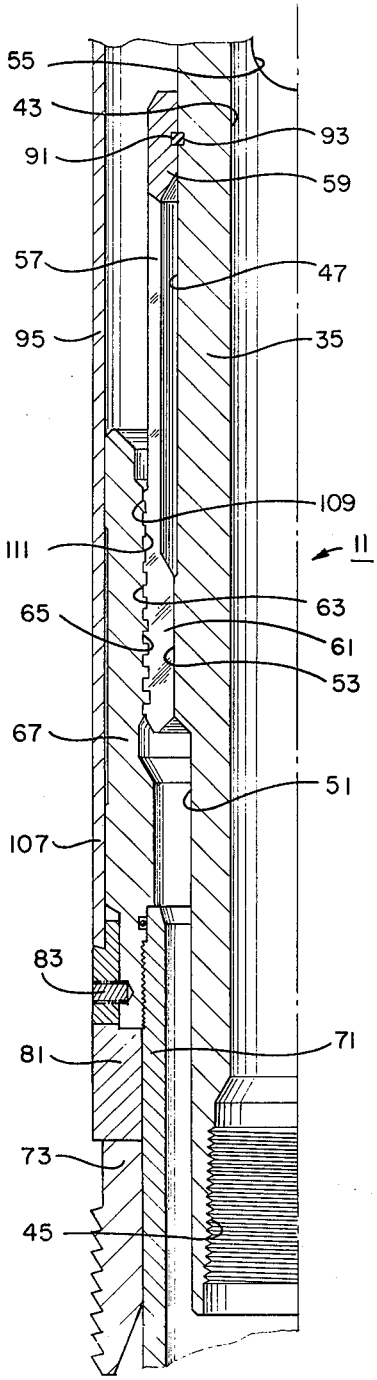

SETTING TOOL ADAPTER KIT

BACKGROUND OF THE INVENTION

The present invention relates generally to downhole tools of the type used in oil and gas wells and, specifically, to an adapter kit of the type used to attach a setting tool to a well packer.

Well packers are downhole tools which include gripping members for engaging a surrounding well conduit such as a well casing and a seal member which is expandable between the packer body and surrounding well conduit to isolate a zone in the well bore in order to treat or produce from the isolated zone. Conventional packers of the type under consideration are set either mechanically, hydraulically, or by means of a wireline setting tool, or by a combination of these setting techniques. The particular setting technique used depends in part upon the well conditions encountered. For instance, in deviated well bores, a hydraulically actuated packer might advantageously be employed.

In the wireline setting tool actuated packer, the packer and setting tool are lowered to the desired depth on a wireline conducting cable. To set the packer, an electrical signal is transmitted to the setting tool which sets off an explosive charge causing the setting tool inner mandrel and outer setting sleeve to move in opposite relative directions to set the packer. Once the packer is set, the setting tool is retrieved to the well surface so that production operations or well testing operations can be commenced. The conventional wireline set packer is, therefore, typically provided with an adapter kit for attaching the setting tool to the packer which adapter kit allows the setting tool to be released after setting the packer so that the setting tool can be retrieved. Prior adapter kits of the type used to attach a setting tool to a well packer have been overly complicated and expensive to manufacture.

There exists a need for an adapter kit for a wireline setting tool which is simple in design and inexpensive to manufacture and which is reliable in operation.

There also exists a need for such an adapter kit which would be automatically released after setting the packer for retrieval to the surface without the need for additional manipulative steps prior to retrieval.

There also exists a need for such an adapter kit which permits assembly of the packer and setting tool without the necessity of rotating either major component.

SUMMARY OF THE INVENTION

The adapter kit of the invention is used to attach a setting tool of the type having a power actuated outer sleeve and a cooperating inner tubular member to a well packer. The adapter kit features a tubular mandrel which has an upper end with upper connecting means adapted to engage mating connecting means on the setting tool inner tubular member. The tubular mandrel has an exterior surface with a ramp area formed in a portion of the mandrel exterior. An expansive member is slidably received about the tubular mandrel with the ramp area beneath the expansive member to expand the member outwardly with respect to the mandrel. The expansive member is provided with an outer threaded surface which is adapted to engage a mating internally threaded surface of the packer. Frangible means are provided for releasably connecting the expansive member to the mandrel exterior with the expansive member in the outwardly expanded position.

The adapter kit also includes a setting sleeve having an upper end with upper connecting means for engaging mating connecting means on the setting tool power actuated outer sleeve and a lower end engagable with the packer setting mechanism. Actuation of the setting tool causes the setting sleeve to set the packer in the conventional manner. As the required setting force is attained and applied to the well packer by the setting sleeve, the frangible means of the adapter kit is severed, allowing the ramp area to move from beneath the expansive member permitting it to collapse and thus disengage the setting tool from the packer.

Preferably, the expansive means is a collet having a collet body and a plurality of expansive collet fingers depending from the body. The collet is slidably received about the tubular mandrel with the ramp area beneath the collet fingers to expand the fingers outwardly with respect to the mandrel. The collet fingers are provided with an outer threaded surface adapted to engage a mating internally threaded surface of the packer head portion. The collet is quenched or otherwise formed in a collapsed position and forceably expanded to the proper thread diameter for engaging the packer head portion by forcing the collet fingers over the ramp area. The frangible means is preferably a shear member such as a shear wire having a preselected shear resistance which is selected to sever upon the application of a predetermined setting force from the setting tool.

Additional objects, features and advantages will be apparent in the written description which follows:

BRIEF DESCRIPTION OF THE DRAWINGS

FIG. 1 is a perspective view of a wireline setting tool and well packer of the present invention with portions of the depending tool string shown broken away.

FIG. 2*a* is a partial side cross-sectional view of the upper portion of the wireline adapter kit of the invention.

FIG. 2*b* is a downward continuation of FIG. 2*a* showing a partial cross-sectional view of the wireline adapter kit of the invention engaging the head portion of a well packer.

DETAILED DESCRIPTION OF THE INVENTION

Figure 4:
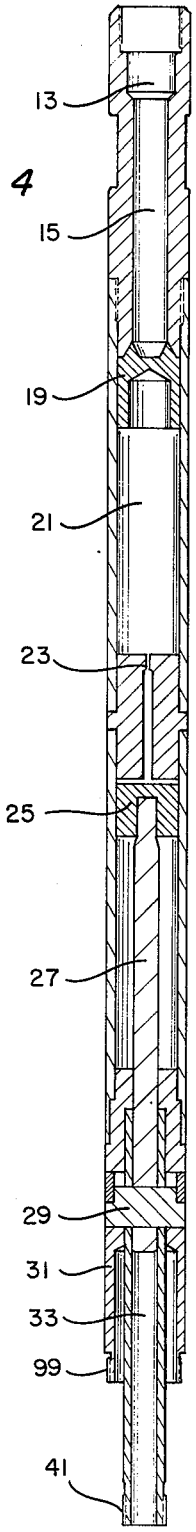
FIG. 4 is a schematic view of a wireline setting tool of the type used with the present invention.

Turning to FIG's. 2*a*–3*b*, there is shown an adapter kit of the invention designated generally as 11. The adapter kit 11 is designed for attaching a setting tool of the type having a power actuated outer sleeve and a cooperating inner tubular member to the head portion of a well packer. Wireline setting tools are well known to those skilled in the art and do not form a part of the present invention. For purposes of illustration, a simplified schematic of a conventional wireline setting tool is shown in FIG. 4. The setting tool, designated generally as 12, includes a firing head 13 with a gas chamber 15 in which is loaded an explosive charge. A wireline conductor cable 17 (FIG. 1) connects the firing head 13 to a detonating device located at the well surface (not shown). Below the gas chamber 15 is located an oil compressing member 19 which forces oil located in an oil chamber 21 through an orifice 23 when the explosive charge is ignited. The oil which is forced through the orifice 23 acts on a piston 25 which is connected through a shaft 27 and cross-link 29 to a power actuated outer sleeve 31. Movement of the outer sleeve 31 downwardly relative to the inner tubular member 33 in the direction of the arrows shown in FIG. 4 provides power setting actuation.

As shown in FIG. 2*a*, the adapter kit 11 includes a tubular mandrel 35 having an upper end 37 with upper connecting means such as internal threads 39 adapted to engage mating connecting means such as external threads 41 on the setting tool inner tubular member 33. The tubular mandrel 35 has a generally cylindrical inner bore 43, a lower opening 45, and an exterior surface 47. Exterior surface 47 has a region of generally uniform external diameter 47 which is joined to a region of lesser relative external diameter 51 by a ramp area 53 formed in a portion of the tubular mandrel exterior surface 47. The tubular mandrel 35 also has a series of vent holes 55 in the sidewalls thereof adjacent the upper end 37.

An expansive means, in this case collet 57, is slidably received about the tubular mandrel exterior surface 47 with the ramp area 53 beneath the expansive means to expand the expansive means outwardly with respect to the mandrel 35. As shown in FIG. 2*b*, the collet 57 has a ring-like collet body 49 and a plurality of expansive collet fingers 61 depending from the body 59. The collet 57 is slidably received about the tubular mandrel 35 with the ramp area 53 beneath the collet fingers 61 to expand the fingers 61 outwardly with respect to the mandrel 35, the collet fingers 61 being provided with an outer threaded surface 63 adapted to engage a mating internally threaded surface 65 of the well packer head portion 67. The collet threaded surface 63 is tapered, as shown in FIG. 2B, to mate with the tapered threaded surface 65 of the packer. The tapered threaded surfaces serves to limit thread make-up between the parts.

Figure 5:
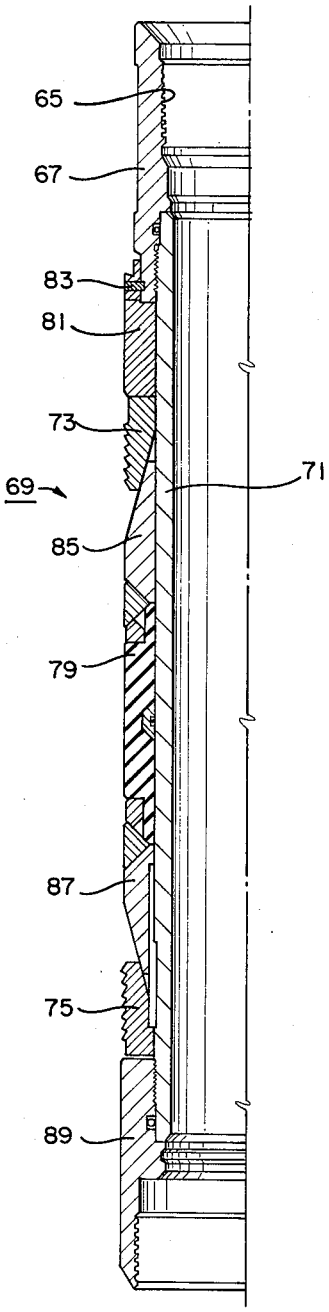
FIG. 5 is a partial cross-sectional view of a well packer of the type used with the present invention.

The well packer (69 in FIG. 1) can be any of the conventional well packers known in the art which is designed to be set with a wireline setting tool. For purposes of illustration, a conventional well packer 69 is shown in simplified schematic form in FIG. 5. The well packer 69 in addition to the packer head portion 67 has a generally cylindrical tubular body 71 which carries upper and lower expanding gripping members 73, 75 which are movable radially outwardly to grip a surrounding well casing 77. The packer 69 also has a centrally located elastomeric seal member 79 which is expandable outwardly for sealing engagement with the well casing 77 to isolate a zone in the well for production, testing, or the like. In the case of the packer 69, downward movement of the setting ring 81 severs a shear pin 83 causing gripping members 73, 75 to be driven radially outwardly by expander members 85, 87 and causing radial outward expansion of seal member 79. Downward movement of the gripping and sealing members is limited by the lower sub 89 which is threadedly engaged with the tubular body 71 at the end thereof opposite the head portion 67.

Returning to FIG. 2*b*, the collet 57 is releasably connected to the mandrel exterior 47 by a frangible means such as a square shear wire 91 which is located in a circumferential keyway 93 provided between the mandrel 35 and collet body 59. The collet 57 is preferably quenched by heat treatment of the metal in a collapsed position or machined to a configuration which when expanded mates with the packer threaded surface 65. The collet 57 is expanded at assembly by passing the collet body 59 over the tubular mandrel ramp to the position shown in FIG. 2*b* with the ramp 53 forcing the collet fingers 61 into an outwardly expanded position. The square shear wire 91 has a preselected shear resistance which is selected to sever upon the application of a predetermined setting force from the setting tool as will be presently described. The square shear wire can be cut to the required length to provide the preselected shear resistance and then be driven into the circumferential keyway 93 through a tangential port (not shown) in the collet body 59. Other frangible means can also be provided such as shear screws and the like which are known in the art.

As shown in FIG's. 2*a*–2*b*, the adapter kit also includes a setting sleeve 95 having an upper end 97 with upper connecting means for engaging mating connecting means on the setting tool power actuated outer sleeve 31. The connecting means can conveniently be an externally threaded outer surface 99 on the setting tool outer sleeve 31 which is connected by means of a suitably threaded bushing 101 to an internally threaded surface 103 on the setting sleeve 95.

The setting sleeve 95 is a generally cylindrical tubular member which has a series of vent holes 105 in the sidewall thereof adjacent the connecting bushing 101. Preferably, four vent holes 105 are evenly spaced about the circumference of the setting sleeve 95. Setting sleeve 95 also has a lower end 107 which is slidably engagable with the packer head portion 67 and contacts the setting ring 81 of the packer. The setting sleeve 95 and packer setting ring 81 are not threadedly engaged.

Figure 3A:
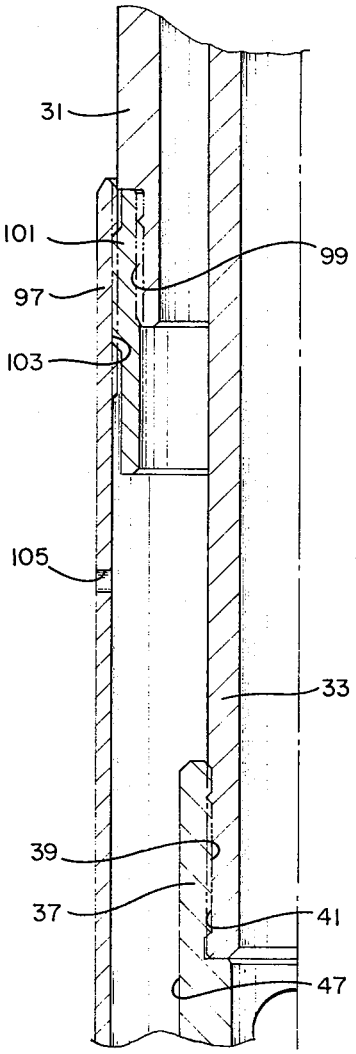
FIG. 3*a* is a partial side cross-sectional view of the upper portion of the wireline adapter kit similar to FIG. 2*a*.
Figure 3B:
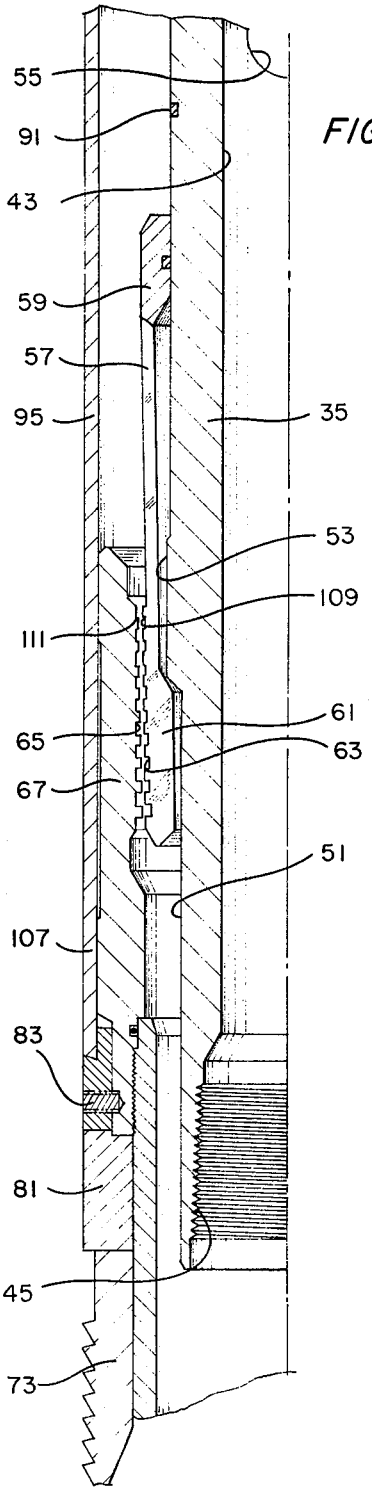
FIG. 3*b* is a partial side cross-sectional view of the wireline adapter kit showing the kit being disengaged from the associated well packer.

Actuation of the setting tool 12 serves to move the setting sleeve 95 and the tubular mandrel 35 in opposite relative directions as has been described. Upon the application of force to the packer gripping and seal members 73, 75 and 79 through the setting sleeve 95, the frangible means 91 prevents movement of the collet 57 and the collet 57 through its engagement with the packer head portion 67 prevents movement of the packer tubular body 71 until the desired setting force is attained on the gripping members 73, 75 and seal member 69 of the packer 69. Once the predetermined setting force has been attained, the frangible means, in this case shear wire 91, is severed thereby allowing the supporting ramp 53 to move from beneath the collet fingers 61, as shown in FIG. 3*b*. Movement of the ramp 53 permits the collet 57 to return to the collapsed quenched position (FIG. 3*b*) to disengage the collet 57 and tubular mandrel 35 from the packer internally threaded surface 65. The setting tool 12 and associated mandrel 35, collet 57, and setting sleeve 95 can then be retrieved to the well surface by means of the wireline 17. The set packer 69 remains in place anchored to the well casing.

The operation of the adapter kit of the invention will now be described in greater detail. The adapter kit is installed by sliding the collet 57 over the tubular mandrel 35, collet body 59 first, so that the collet body 59 passes over the ramp area 53 with the collet fingers 61 being forced over the ramp area 53 to forceably expand the collet fingers 61 radially outwardly with respect to the tubular mandrel exterior 47. The collet 57 can be formed having the desired collapsed-expandable characteristics by techniques known in the art such as heat treatment of the part to quench the metal in the collapsed position, or the collet 57 can be machined using known techniques to the desired configuration.

The collet 57 is then releasably connected to the mandrel exterior 47 with the collet fingers 61 in the expanded position shown in FIG. 2*b* by inserting a shear wire 91 in a circumferential keyway 93 through a suitably provided tangential port in the collet body 59. The mandrel 35 and associated collet 57 are then threadedly connected to the packer head portion 67 by engaging the collet surface 63 with the mating threaded surface 65 in the packer head portion 67. This can be accomplished by rotating only the collet 57. Thread make-up is limited by the tapered thread root 109 of the collet 57 and the matching tapered bore 111 of the packer internally threaded surface 65.

The setting tool 12 and its associated setting sleeve 95 are positioned on the packer head 67 as shown in FIG's. 2*a* and 2*b* and the setting tool cooperating inner tubular member 33 (shown in dotted lines in 2*a*) is engaged with the tubular mandrel 35 upper end 37. The assembled packer and setting tool are then lowered to the desired depth within the well bore, as shown in FIG. 1. As the setting tool and packer are being lowered, well fluids are allowed to circulate through the bore 43 of the tubular mandrel 35 out the vent holes 55 and through the vent holes 105 in the setting sleeve to the surrounding well bore. The setting tool is then actuated to effect opposite relative longitudinal movement of the setting sleeve 95 and cooperating inner tubular member 33.

Downward relative movment of the setting sleeve 95 causes expansion of the gripping and sealing members 73, 75 and 79 to anchor the packer in position in the well bore and seal off the annular region between the packer body and the well casing. As the desired setting force is achieved through the setting sleeve 95, shear wire 91 severs allowing the tubular mandrel 35 to move upwardly relative to the packer head portion 67. Upward movement of the tubular mandrel 35 allows the ramp area 53 to move from beneath the collet fingers 61 as shown in FIG. 3*b* thereby releasing the threaded engagement between the collet fingers 61 and the mating internally threaded surface 65 of the packer head portion 67. Although these events have been described in sequential fashion, it will be appreciated that the setting action and subsequent release of the tubular mandrel 35 are practically simultaneous due to the explosive actuation of the power setting tool 12. The setting tool 12, tubular mandrel 35, and setting sleeve 95 an then be raised to the well surface with the wireline 17, leaving the set packer 69 in the well bore.

An invention has been provided with significant advantages. The adapter kit of the invention is simple in design, easy to install and reliable in operation. The reduction in the number and complexity of component parts provides economy in material and labor. The packer and setting tool can be assembled using the adapter kit without the necessity of rotating either of the major components since the adapter collet alone can be rotated for attachment to the packer. The vent holes in the setting sleeve and adapter kit tubular mandrel allow well fluids which pass into the bore of the tubular mandrel to be circulated back out into the well bore while running into position in the well. The expanding collet and frangible connection provide automatic release of the setting tool and setting sleeve once the desired setting force on the packer elements is attained, thereby providing ease of disengagement of the tool.

While the invention has been shown in only one of its forms, it is not thus limited but is susceptible to various changes and modifications without departing from the spirit thereof.

I claim:

1. A method of installing an adapter kit for attaching a wireline setting tool of the type having a power actuated outer sleeve and a cooperating inner tubular member to a well packer, comprising the steps of:

providing a tubular mandrel having an upper end with upper connecting means adapted to engage mating connecting means on said setting tool inner tubular member, an exterior, and a ramp area formed in a portion of said exterior;

forming a collet with a ring-shaped collet body and a plurality of externally threaded collet fingers, said fingers being expandable outwardly from a normally collapsed position of a lesser relative diameter to an expanded position of greater relative diameter;

sliding said collet over said tubular mandrel so that said collet fingers are forced over said ramp area to forceably expand said fingers to a preselected diameter, whereby said collet finger external threads are engagable with a mating surface of said packer;

releasably connecting said collet to said mandrel exterior with said collet fingers in said expanded position; and engaging said threaded collet fingers with a mating surface of said packer by rotating said collet about said tubular mandrel while holding said packer stationary.

2. The method of claim 1, wherein said collet is connected to said mandrel exterior by passing a square shear wire into a circumferential keyway provided between said mandrel exterior and an interior surface of said collet body, said square shear wire having a preselected shear resistance selected to sever upon the application of a predetermined setting force from said setting tool.

3. An adapter kit for attaching a wireline setting tool of the type having a power actuated outer sleeve and a cooperating inner tubular member to a well packer, both the setting tool and attached well packer being initially suspended from a wireline conducting cable in a well, comprising:

a tubular mandrel having an upper end with upper connecting means adapted to engage mating connecting means on said setting tool inner tubular member, an exterior, and a ramp area formed in a portion of said exterior;

a collet having a collet body and a plurality of expansive collet fingers depending therefrom, said collet being slidably received about said tubular mandrel with said ramp area beneath said collet fingers to expand said fingers outwardly with respect to said mandrel, said collet fingers being provided with an outer threaded surface adapted to engage a mating internally threaded surface of said packer, said collet being provided in a collapsible position and being forceably expanded to the proper thread diameter for engaging said packer internally threaded surface by forcing said collet fingers over said ramp area;

frangible means for releasably connecting said collet to said mandrel exterior with said fingerss in said outwardly expanded position; and a setting sleeve having an upper end with upper connecting means for engagingly mating connecting means on said settng tool power actuated outer sleeve and a lower end engagable with said packer whereby actuation of said setting tool serves to move said setting sleeve and said tubular mandrel in opposite relative directions to sever said frangible means and move said ramp area from beneath said collet fingers to disengage said collet and setting tool from said packer.

4. The adapter kit of claim 3, wherein said collet finger threaded surfaces are tapered to mate wtih a tapered threaded surface of said packer to limit make-up between the collet and packer during assembly.

5. The adapter kit of claim 3, wherein said frangible means is a square shear wire located in a circumferential keyway provided between said mandrel exterior and an interior surface of said collet body, whereby said collet is rotatable about said mandrel, and said square shear wire having a preselected shear resistance selected to sever upon the application of a predetermined setting force from said setting tool.

* * * * *